US010603559B1

(12) United States Patent
Farley

(10) Patent No.: US 10,603,559 B1
(45) Date of Patent: Mar. 31, 2020

(54) COLLAPSIBLE ARCADE GAME

(71) Applicant: Indian Industries, Inc., Evansville, IN (US)

(72) Inventor: Patrick Farley, Bay Shore, NY (US)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 15/988,083

(22) Filed: May 24, 2018

(51) Int. Cl.
*A63B 63/08* (2006.01)
*A63B 69/00* (2006.01)
*A63B 63/00* (2006.01)

(52) U.S. Cl.
CPC ..... *A63B 63/083* (2013.01); *A63B 69/0071* (2013.01); *A63B 2063/001* (2013.01); *A63B 2210/50* (2013.01)

(58) Field of Classification Search
CPC ..... A63B 63/083; A63B 69/0071; A63B 2210/50; A63B 2063/001
See application file for complete search history.

(56) References Cited

U.S. PATENT DOCUMENTS 1,821,918 A 9/1931 Bishop
1,901,732 A 3/1933 Clark
2,069,487 A 2/1937 Riper
2,468,194 A 4/1949 Hall
D214,066 S 5/1969 Benigno
3,777,674 A 12/1973 Parsons
4,210,328 A 7/1980 Meintzer et al.
4,345,758 A 8/1982 Kempf
4,872,679 A 10/1989 Bohaski et al.
4,995,611 A 2/1991 Goldthorpe
5,104,124 A 4/1992 Bernard et al.
5,133,546 A 7/1992 Matherne et al.
D333,492 S 2/1993 Paredes
5,310,176 A * 5/1994 Berg ..... A63B 63/083 473/433
5,692,976 A 12/1997 Yu
5,788,242 A 8/1998 Rudell et al.
5,816,954 A * 10/1998 Zheng ..... A63B 9/00 473/471
6,082,386 A * 7/2000 Zheng ..... A63B 9/00 135/119
6,224,504 B1 5/2001 Tien
6,481,451 B1 11/2002 Zheng
6,565,460 B2 5/2003 Wang
6,698,441 B1 * 3/2004 Zheng ..... A63B 9/00 135/117

(Continued)

*Primary Examiner* — Jeffrey S Vanderveen
(74) *Attorney, Agent, or Firm* — Woodard, Emhardt, Henry, Reeves & Wagner, LLP; Charles Meyer

(57) ABSTRACT

An arcade game system includes a frame that is made from an arrangement of pivotally connected panels that are formed from an assembly of struts arranged in a planar configuration. The frame includes a rear panel, a front panel, and a first and second body panel. When the frame is in an unfolded configuration a game play area is defined between the rear panel and the front panel and above the first body panel and the second body panel. The frame may also be arranged in a collapsed configuration in which each of the rear panel, first body panel, second body panel, and front body panel are parallel to each of the other panels to form a stack of panels.

20 Claims, 11 Drawing Sheets

(56) References Cited

U.S. PATENT DOCUMENTS

| | | | | |
|---|---|---|---|---|
| 7,125,351 | B1 * | 10/2006 | Raber | A63B 63/004 473/478 |
| 7,247,105 | B2 | 7/2007 | Huntsberger | |
| 7,509,695 | B2 | 3/2009 | Zheng | |
| 9,468,840 | B2 | 10/2016 | Nally | |
| 9,533,210 | B2 | 1/2017 | Lee | |
| 2005/0189717 | A1 | 9/2005 | Wieland | |
| 2016/0023095 | A1 * | 1/2016 | Nally | A63B 67/06 273/343 |
| 2018/0250567 | A1 | 9/2018 | Luo et al. | |

* cited by examiner

COLLAPSIBLE ARCADE GAME

FIELD OF THE INVENTION

The present disclosure deals with arcade game systems.

BACKGROUND

Sports games such as basketball, baseball, football, and archery are popular, but can require a lot of space to play an actual game. When the requisite space is not available, a smaller scale game, such as a mechanical arcade game, may be used that requires less space and may be played with fewer people. Mechanical arcade games differ from electric games or video games in that a mechanical arcade game provides a target for a player to physically throw or shoot a projectile toward, such as a basketball goal or an archery target. Mechanical arcade games may be set up for entertainment indoors such as in a garage, basement, or in a game room.

In some instances, the game is able to be taken apart for storage when the game is not in use and then reassembled when needed. However, this process can be complicated and time consuming, as the game may include several different pieces that have to be disassembled.

Thus, there is a need for improvement in this field.

SUMMARY

Certain embodiments include an arcade game system that is capable of being arranged in an unfolded configuration for game play and in a collapsed position for storage. The arcade game system includes a frame that includes an arrangement of panels. Each of the panels is formed from an assembly of struts that are arranged in a planar configuration.

When the frame is in an unfolded configuration, the arcade game system defines a player position adjacent to and in front of the front panel. A game play area is defined between the vertical rear panel and the vertical front panel and above the first body panel and the second panel. A target is positioned on the upper section of the rear panel. An apron extends from the rear panel to the front panel beneath the game play area and over the first body panel and the second body panel.

The frame includes a rear panel that has an upper section and a lower section. The upper section is foldable with respect to the lower section. In certain embodiments, the upper section is foldable rearwardly with respect to the lower section. The frame also includes a first intermediate body panel and a second intermediate body panel. The first body panel is pivotally connected to the rear panel, and the second body panel is pivotally connected to the first body panel. A front panel is pivotally connected to the second body panel.

In the unfolded configuration, the first body panel is positioned at an oblique angle with respect to the rear panel and the second body panel is positioned at an oblique angle with respect to the front panel. When the frame is in the collapsed configuration, the rear panel, first body panel, second body panel, and front body panel are parallel to each of the other panels to form a stack of panels. In the unfolded configuration, the height of the rear panel is greater than the height of the front panel. In the collapsed configuration, the upper section of the rear panel is folded with respect to the lower panel of the rear panel so that the height of the rear panel is shorter in the collapsed configuration.

Some embodiments include a method for arranging an arcade game system into a collapsed configuration from an unfolded configuration. The arcade game system includes a frame with a front panel, a rear panel, and first and second body panels. In the unfolded configuration, the first and second body panels are arranged at oblique angles with respect to the vertical front panel and the vertical rear panel. To move the arcade game system into the collapsed configuration from the unfolded configuration, the front panel is pivoted with respect to the second body panel so that the front panel is parallel to the second body panel. The second body panel is then pivoted with respect to the first body panel so that the second body panel and the front panel are parallel to the first body panel. Then, the first body panel is pivoted with respect to the rear panel so that the first body panel, the second body panel, and the front panel are parallel to the rear panel. An upper section of the rear panel is folded rearwardly with respect to a lower section of the rear panel so that the upper section of the rear panel is parallel to the lower section of the rear panel.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
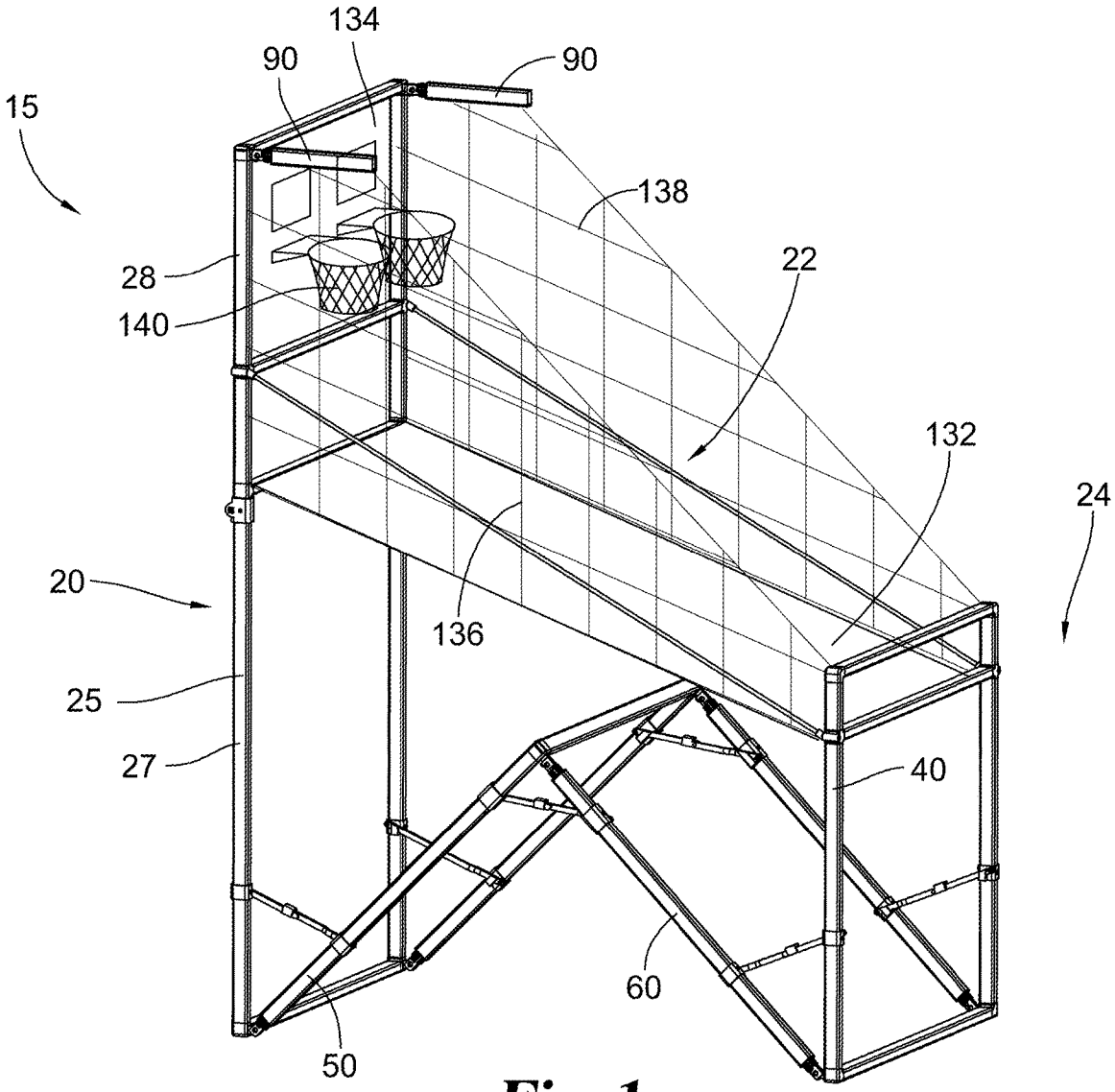
FIG. 1 is a perspective view of an arcade game in an unfolded configuration.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The present disclosure pertains generally to the field of mechanical arcade games and more particularly to a foldable arcade system. In summary, the arcade game includes a frame upon which can be mounted a target, for instance, a backboard with basketball rims. A game play area may be enclosed on both sides with nets and with an apron to catch and return the ball to the player. The game can be converted to play baseball or football tossing games by mounting a rectangular screen with target holes in front of the basketball rims. The corners of the screen can be secured or dismounted via elastic bands and connectors extending from the four screen corners to locations on the frame. Other types of targets may alternately be used.

The frame consists of a series of struts forming frame panels which are pivotally interconnected. In the expanded configuration, the panels form a somewhat W shaped profile. In the collapsed or folded configuration the panels form a stacked profile with a total thickness defined by the stacked thicknesses of the panels. The panels include a series of hinged braces which can be selectively locked to lock the W profile in the open configuration. A rear panel of the W includes lockable hinges at a midpoint, which enable an upper panel or set of struts to be rotated to a raised or lowered between an upper position and a lower position. In some embodiments, a set of cables extend between the front panel and the rear panel providing tension and bracing between the front panel and the upper section of the rear panel. Optionally, a set of hinged net supports extend forward from the upper edge of the upper section of the rear panel. When desired, the various hinged braces and hinges can be unlocked and the respective portions folded and pivoted to collapse the frame to the collapsed configuration.

Figure 2:
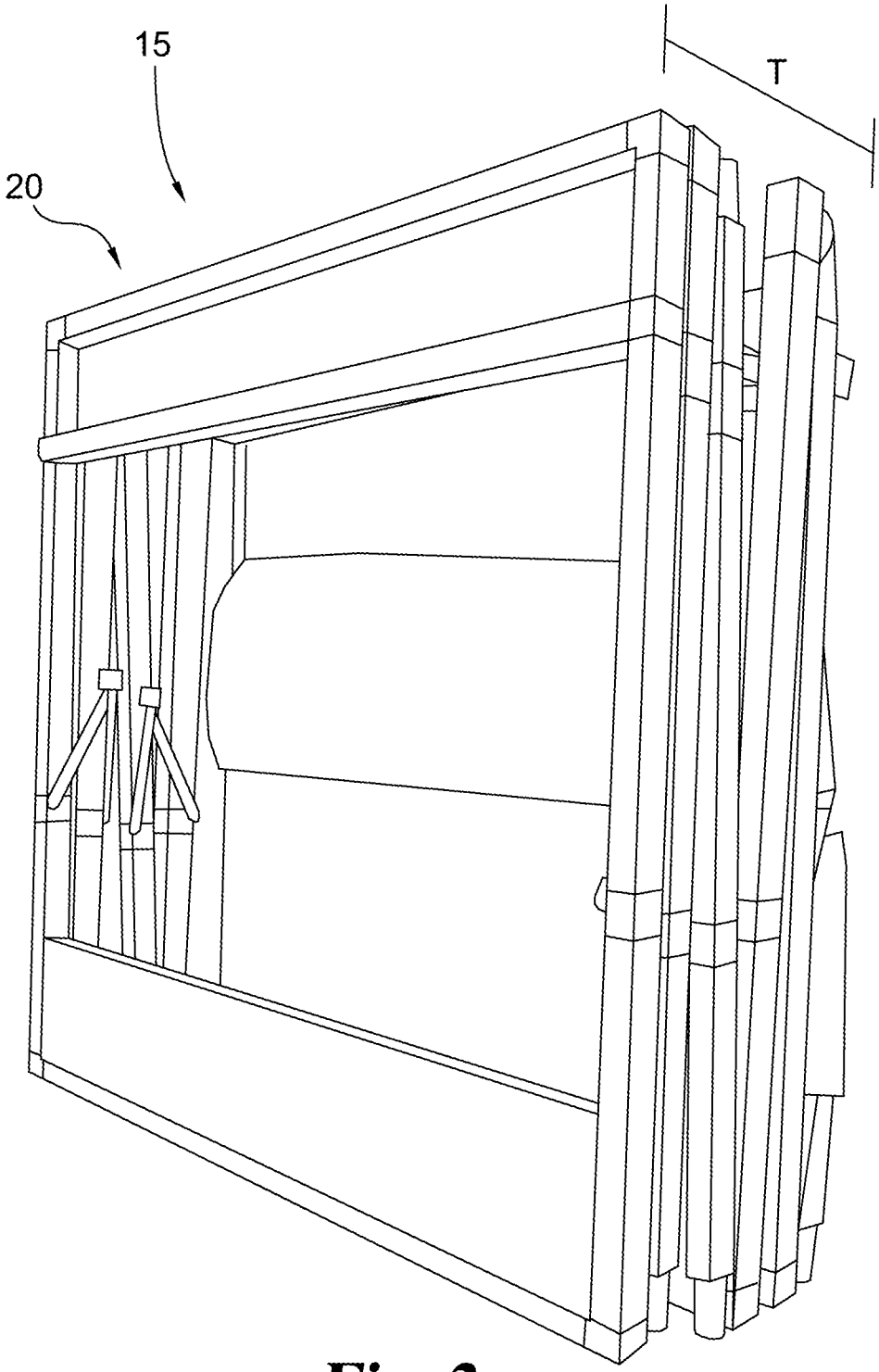
FIG. 2 is a perspective view of the arcade game of FIG. 1 in a collapsed configuration.

FIG. 1 is a representative view of an arcade game 15 that includes a frame 20 that is selectively configurable between an unfolded configuration and a collapsed configuration (see FIG. 2). In the unfolded configuration, arcade game 15 defines a game play area 22 or volume and a player position 24 adjacent to and in front of frame 20. In the folded configuration of FIG. 2, the total thickness T of frame 20 is the sum of the thickness of the frame panels.

Frame 20 comprises panels or sections that are formed from a series of side struts that are connected by cross struts at the top and bottom of the side struts so that each panel has an open center portion. Additional cross struts may extend between the side struts at intermediate points between the ends of the side struts. Generally, the struts are arranged so that each panel is rectangular and lies in a single plane. Two panels may share a cross strut where the panels are pivotally joined.

Figure 4:
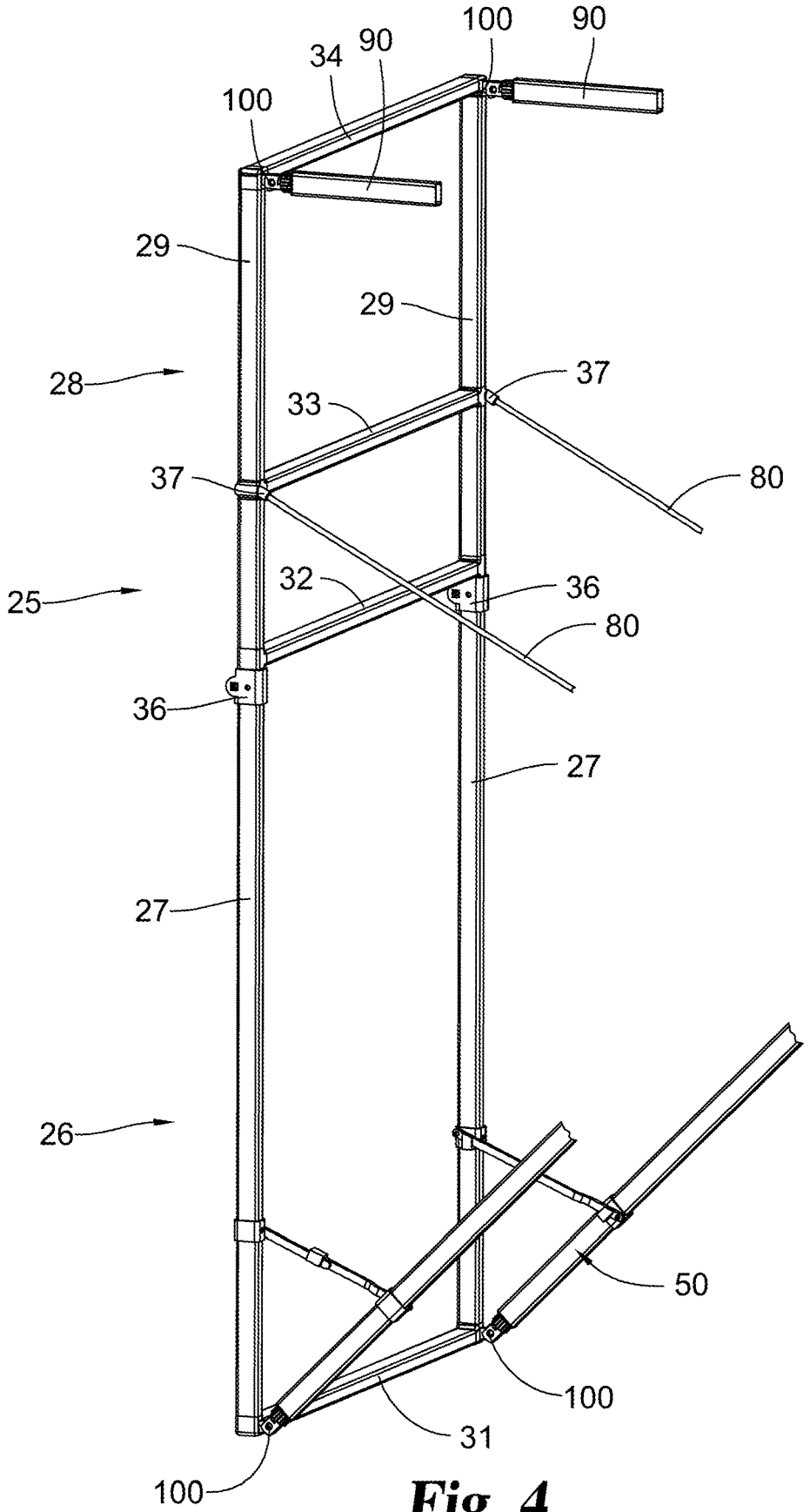
FIG. 4 is a perspective view of a rear panel for the frame of FIG. 2.
Figure 5:
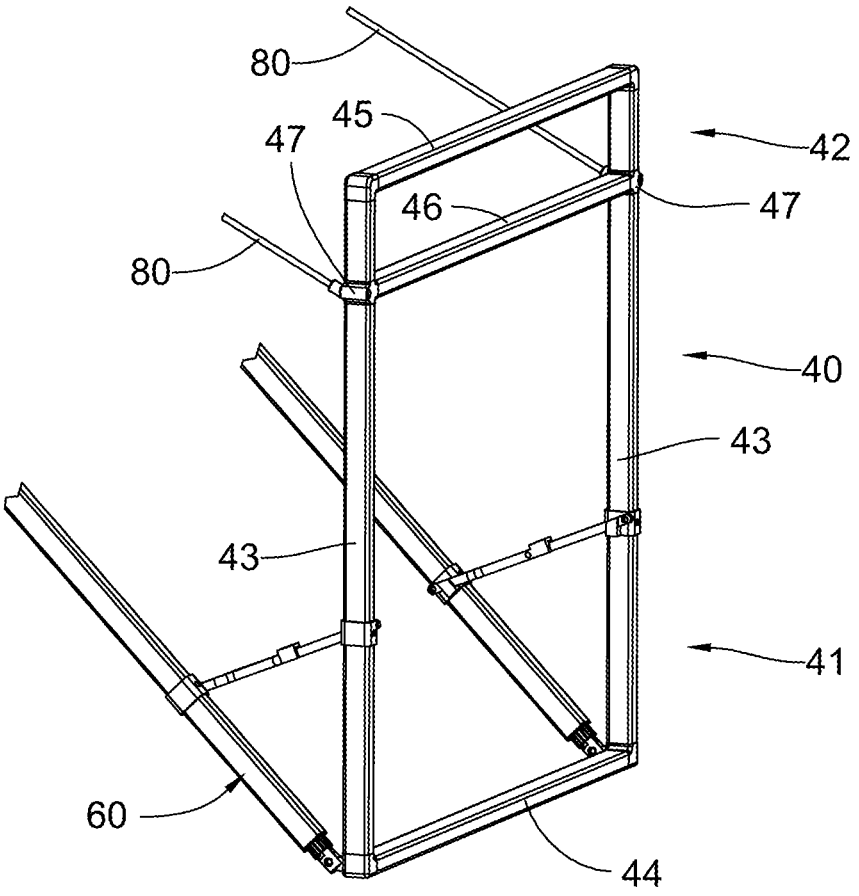
FIG. 5 is a perspective view of a front panel for the frame of FIG. 2.
Figure 6:
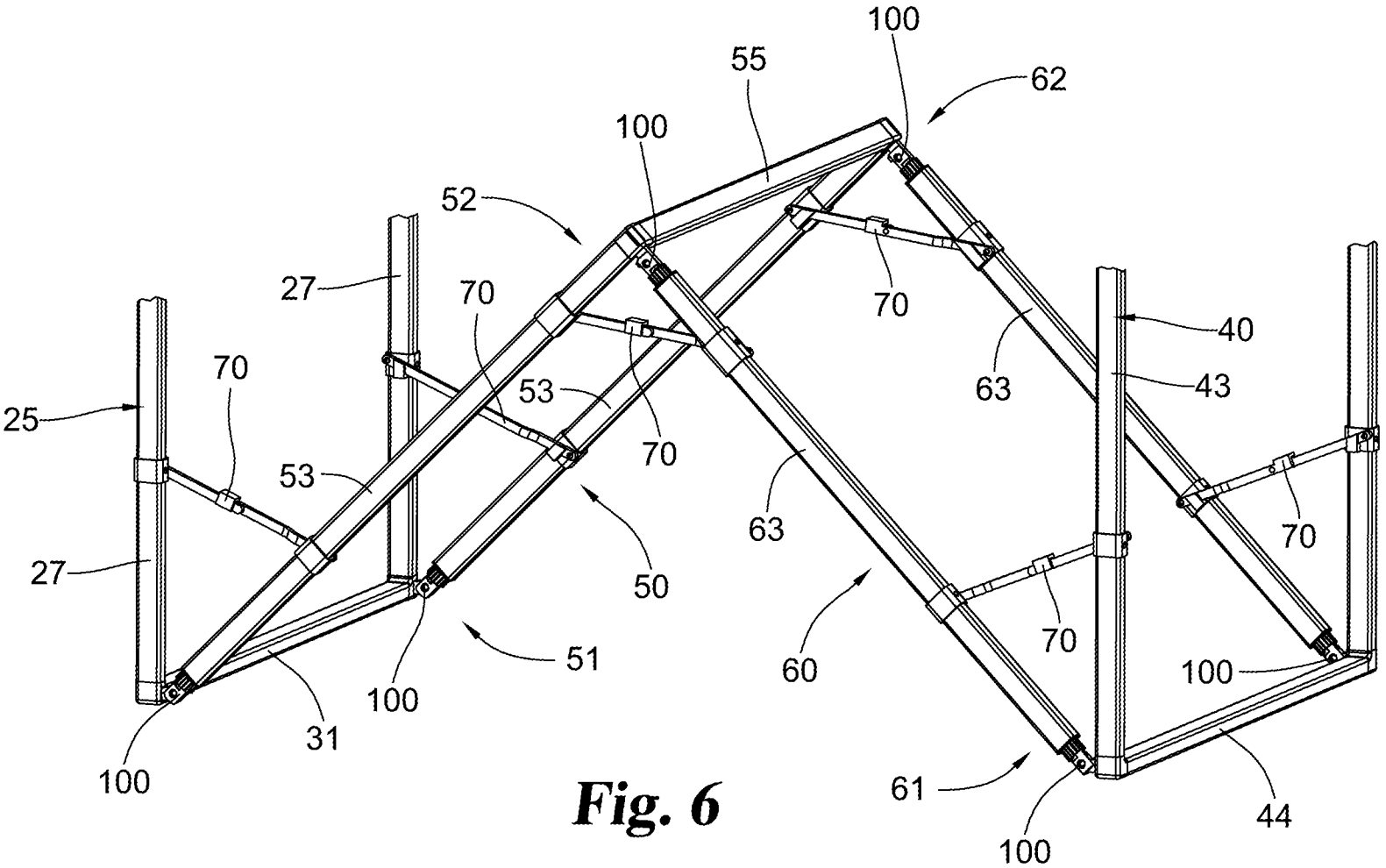
FIG. 6 is a perspective view of body panels for the frame of FIG. 2.

In an alternate way of describing the panels, as shown in detail in FIG. 5 front panel 40 has a perimeter of two side struts 43, lower cross strut 44 and upper cross strut 45. As illustrated in FIG. 4, the lower section of rear panel 25 has at least two side struts 27 and lower cross struts 31 forming an upward U profile which may be open or closed at the top. In FIG. 6, first body panel 50 is formed of two side struts 53 and upper cross strut 55 forming a downward opening U profile with the open end of the U closed by the lower cross strut 31 of rear panel 25. Second panel 60 is formed by a pair of side struts 63 connected at their upper ends by the upper cross strut 55 of first panel 60. The lower ends of the second panel side struts 63 are connected by lower cross strut 44 of front panel 40.

Figure 3:
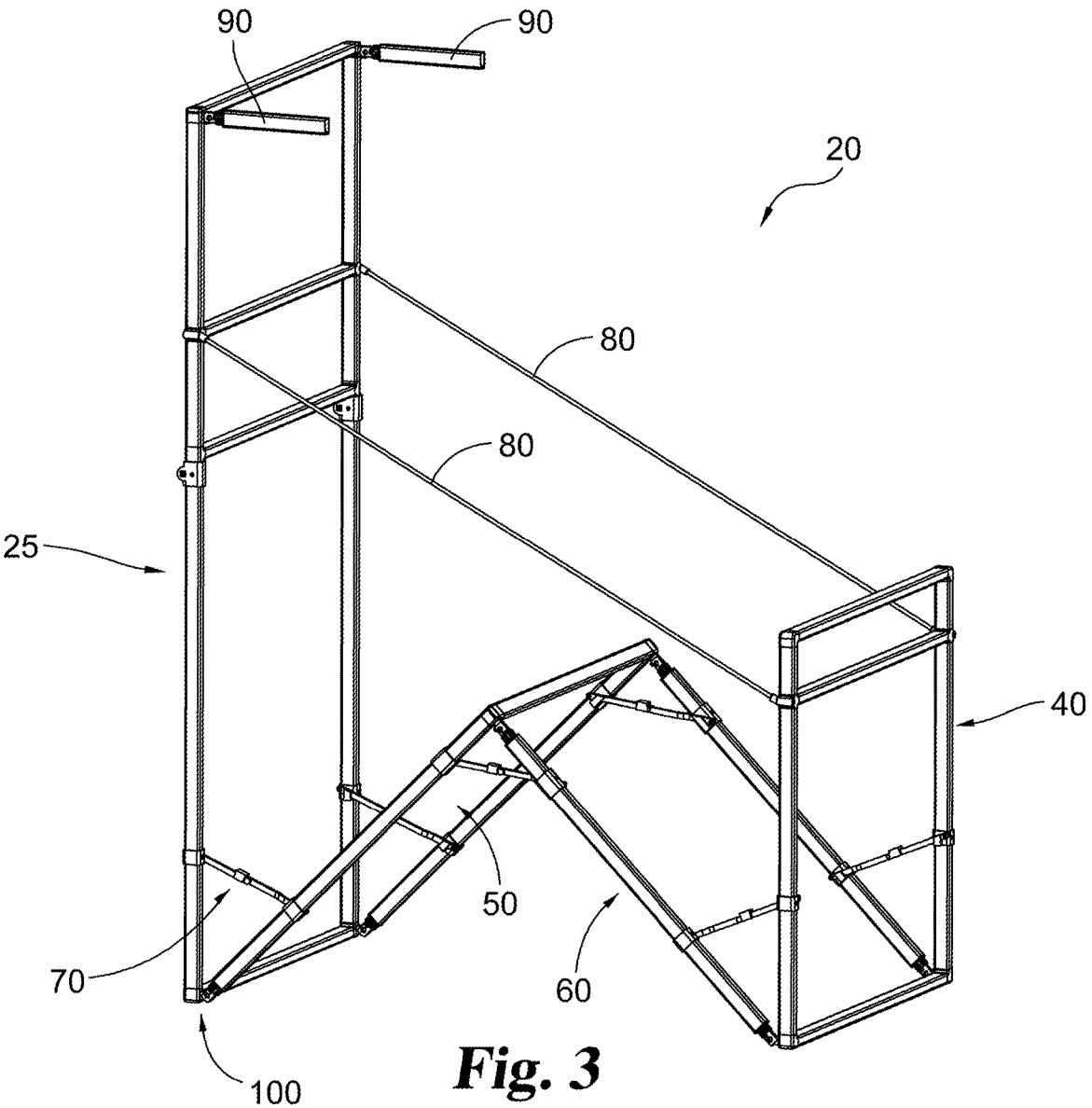
FIG. 3 is a perspective view of a frame for the arcade game of FIG. 1.

As illustrated in FIG. 3, in the unfolded configuration frame 20 includes a vertical rear panel 25 and a vertical front panel 40, where rear panel 25 has a height that is greater than the height of front panel 40. The lower ends of each of the rear panel 25 and the front panel 40 rest on a support surface, such as the ground.

Rear panel 25 and front panel 40 are connected by intermediate first and second body panels 50, 60. In the unfolded configuration, body panels 50, 60 are oriented at oblique angles with respect to vertical rear panel 25 and vertical front panel 40 to form a W-shaped profile when viewed from a side perspective. Adjacent panels are connected by pivot connections 100 which allow the adjacent panels to pivot or rotate with respect to each other. Hinged braces 70 connect between adjacent panels and may be used to secure a panel in a desired orientation with respect to an adjacent panel. Although FIG. 1 shows two intermediate body panels, other embodiments may include fewer or more body panels as desired.

In some embodiments, a set of cables 80 extend from an upper portion of rear panel 25 and angle downward to front panel 40 to provide tension and bracing for the frame 20 between rear panel 25 and front panel 40. Optional net supports 90 extend from rear panel 25 and provide support locations for sidewall nets that may extend from rear panel 25 to front panel 40. Net supports 90 are hinged so that each net support 90 can be folded to be parallel with respect to rear panel 25 or so that the net support 90 can be positioned perpendicularly with respect to rear panel 25.

As shown in FIG. 4, rear panel 25 includes a lower subpanel 26 and an upper subpanel 28. Lower subpanel 26 includes a pair of side struts 27 and upper subpanel includes a corresponding pair of side struts 29. In some embodiments, the lower side struts 27 may be arranged so they substantially parallel. Likewise, the upper side struts 29 may be arranged so that they are substantially parallel. The lower subpanel 26 of rear panel 25 includes a pivot connection 100 for connecting subpanel 26 to intermediate body panel 50.

Upper subpanel 28 may include pivot connections 100 for connecting corresponding net supports 90. A pivot connection 100 connected to a net support 90 allows the net support 90 at least 90 degrees of rotation so that net support 90 can be folded on top of side strut 29 or extends horizontally from side strut 29.

Cross struts 31, 32, 33, 34 extend as cross braces between side struts 27, 29 at various heights alongside struts 27, 29. Cross strut 31 is found in the lower subpanel 26 of rear panel 25 and serves as a base that rests on the floor or on the ground when frame 20 is in an unfolded configuration. The additional cross struts 32, 33, 34 assist to stabilize side struts 27, 29 and may provide attachment and support points for game equipment that may be attached to frame 20. For example, cross strut 32 extends between side struts 27, 29 adjacent the connection between lower subpanel 26 and upper subpanel 28. Cross struts 33, 34 may be located in the upper subpanel 28 and extend between side struts 29.

Each of the cables 80 are attached to rear panel 25 at a cable connection 37. In the embodiment shown, cable connections 37 are located on each of the side struts 29 near cross strut 33. In other embodiments, cable connections 37 may be positioned at other locations on rear panel 25, such as near cross strut 32 or between cross struts 32 and 33. Cables 80 may be attached to rear panel 25 at upper subpanel 28 and be angled downward to attach to front panel 40. Cables 80 may provide support assisting to keep rear panel 25 and front panel 40 upright and substantially parallel to each other when frame 20 is in the unfolded configuration and may also act as a support for side netting around game play area 22.

Lower subpanel 26 and upper subpanel 28 of rear panel 25 are connected by a pair of hinges 36 between struts 27 and struts 29. Each hinge 36 is foldable so that lower subpanel 26 and upper subpanel 28 can be folded to place frame 20 in a collapsed configuration. By folding upper subpanel 28 with respect to lower subpanel 26, the height of rear panel 25 in the collapsed configuration is shorter than the height of rear panel 25 in the unfolded configuration. In some embodiments, each hinge 36 may be a one-way hinge that only allows upper subpanel 28 to pivot rearwardly with respect to lower subpanel 26 and does not allow upper subpanel 28 to pivot forward past a vertical position with respect to lower subpanel 26.

When frame 20 is in the unfolded configuration, the cables 80 are under tension and help prevent upper subpanel 28 from folding with respect to lower subpanel 26. However, when cables 80 are relaxed and/or unattached from either rear panel 25 or front panel 40, upper subpanel 28 may be rotated downward with respect to hinge 36 parallel to lower subpanel 26. In some embodiments, upper subpanel 28 is folded rearwardly so that upper subpanel 28 is folded in a direction away from front panel 40. Folding lower subpanel 26 and upper subpanel 28 reduces the height of frame 20 and creates a smaller footprint for storage.

As illustrated in FIG. 5, front panel 40 includes a lower section 41 and an upper section 42 and includes a pair of side struts 43. The side struts 43 may be arranged so that side struts 43 are substantially parallel. Each side strut 43 extends between a lower cross strut 44 and an upper cross strut 45. In this embodiment, an additional cross strut 46 extends as a cross brace between side struts 43, substantially parallel to lower cross strut 44 and upper cross strut 45. Cable connections 47 are positioned on side struts 43 to serve as an attachment points for cables 80 extending from rear panel 25. In the embodiment shown, cable connections 47 are at the same height as support strut 46, but in other embodiments, cable connections 47 may be positioned at any desired height on side struts 43.

Illustrated in FIG. 6, one intermediate body panel 50 includes a lower body portion 51 and an upper body portion 52 formed by a pair of side struts 53 that are substantially parallel. A cross strut 55 connects side struts 53 at the upper body portion 55. Each of the side struts 53 is pivotally connected to rear panel 25 at a pivot connection 100 on the lower body portion 51, allowing body panel 50 to pivot with respect to rear panel 25 on a support surface. A hinged brace 70 extends between each side strut 27 of rear panel 25 and the corresponding side strut 53 of body panel 50, allowing the panels 25, 50 to be locked at an oblique angle when pivoted to a desired unfolded configuration.

A second intermediate body panel 60 includes a lower body portion 61 supported by a support surface and an upper body portion 62 formed by a pair of side struts 63 that are substantially parallel. At upper body portion 62, each side strut 63 connects to a corresponding side strut 53 and/or cross strut 55 of body panel 50 at a pivot connection 100 so that body panel 60 is pivotable with respect to body panel 50. A hinged brace 70 is connected between each pair of side struts 53, 63 to allow body panels 50, 60 to be locked and to prevent pivoting once body panels 50, 60 are arranged in a desired, unfolded configuration.

At lower body portion 61, each side strut 63 connects to a corresponding side strut 43 or cross strut 44 of front panel 40 so that body panel 60 is pivotable with respect to front panel 40. A hinged brace 70 is connected between each pair of side struts 43, 63 to allow front panel 40 and body panel 60 to be locked and prevented from pivoting once the panels 40, 60 are arranged in a desired, unfolded configuration.

Figure 7:
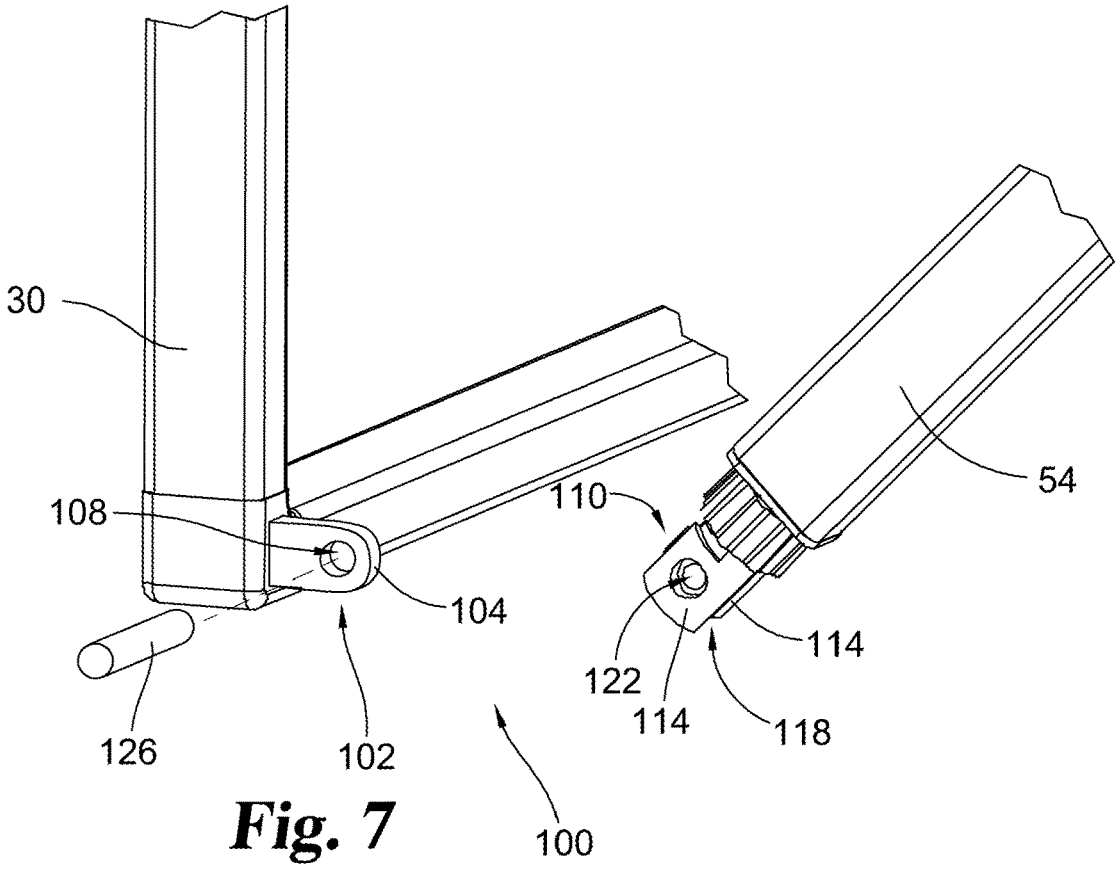
FIG. 7 is a schematic view of a hinged connection of FIG. 2.

FIG. 7 illustrates an embodiment of an example pivot connection 100. Pivot connection 100 includes a male fitting 102 that includes a body 104 and a pin opening 108 defined through body 104. As shown, male fitting 102 is positioned on a strut, such as vertical strut 30 or cross brace 31 of rear panel 25, and extends from the strut toward an adjacent panel. Pivot connection 100 also includes a female fitting 110 that extends from a different strut than male fitting 102, such as side strut 53 on body panel 50 adjacent to rear panel 25. Female fitting 110 includes prongs 114 which define a gap 118 between prongs 114. Prongs 114 are arranged so that male fitting 102 may be positioned within gap 118. Aligned pin openings 122 are defined through each of the prongs 114 and are sized to correspond to pin opening 108 on male fitting 102.

Male fitting 102 may be placed within gap 118 of female fitting 110 and positioned so that pin openings 108, 122 align. A pin 126 is inserted through aligned pin openings 108, 122 to secure the adjacent panels to each other. Male fitting 102 and female fitting 110 are able to rotate with respect to each other about pin 126 so that adjacent panels connected at pivot connections 100 are capable of pivoting with respect to the adjacent panel.

In other embodiments, different forms of connections that allow the panels to pivot with respect to each other may be used rather than the pivot connection 100 shown in FIG. 7. As an example pivot connection 100 may be formed by a ball and socket joint where one strut includes a ball that is fit into a socket in a corresponding strut. Additionally, other suitable forms of hinged connections may be used.

Figure 8:
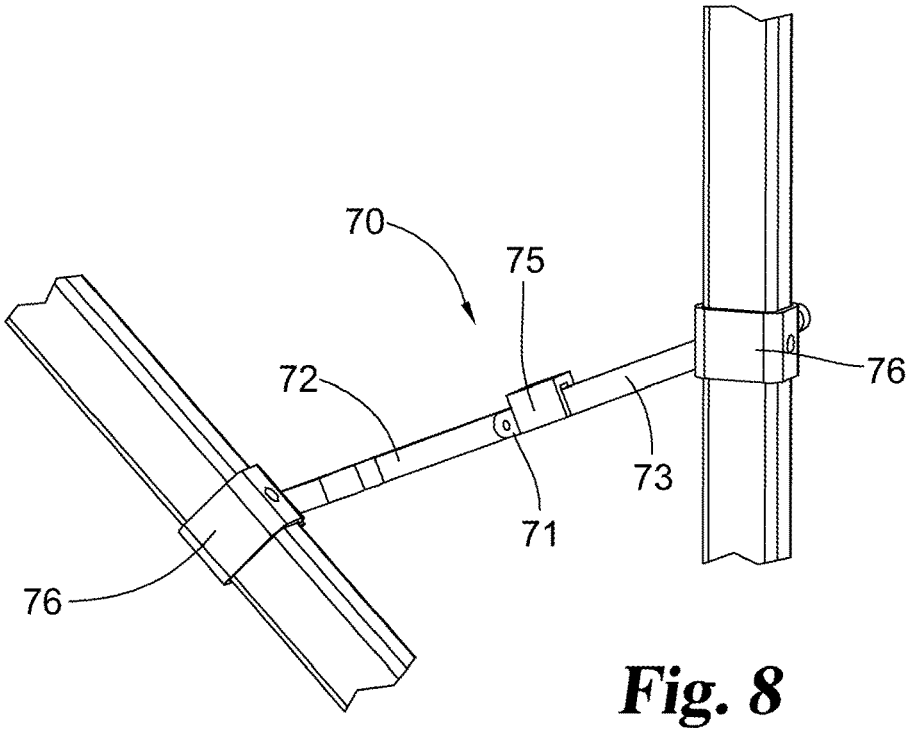
FIG. 8 is a side view of a hinged brace for the frame of FIG. 2.

An embodiment of a hinged brace 70 is shown in FIG. 8. Hinged brace 70 includes a hinge 71 that connects two support arms 72, 73, allowing the two support arms 72, 73 to pivot with respect to each other. A slidable lock 75 is positioned around at least one of the support aims 72, 73 so that it may slide along the support arms 72, 73. To unlock the hinged brace 70, slidable lock 75 is slid along support arm 72 or 73 so that slidable lock 75 does not cover hinge 71. To lock the hinged brace 70, slidable lock 75 is slid along support arm 72 or 73 when the arms are aligned so that slidable lock 75 covers hinge 71, preventing support arms 72, 73 from pivoting with respect to each other. A strut attachment 76 is positioned at each end of hinged brace 70.

One of the strut attachments 76 is attached to a panel of frame 20 and the other strut attachment 76 is attached to a different, adjacent panel of frame 20. Hinged brace 70 includes a locked position in which the support arms 72, 73 are positioned substantially linearly with respect to each other. When support arms 72, 73 are in the locked position, the adjacent panels to which the hinged brace 70 is attached are restricted from pivoting with respect to each other. Hinged brace 70 also includes an unlocked position in which the support arms 72, 73 are positioned non-linearly with respect to each other. In the unlocked position, the adjacent panels to which the hinged brace 70 is attached are permitted to pivot with respect to each other.

As shown in FIG. 1, arcade game 15 includes a game play area 22 and defines a player position 24 located in front of and adjacent to front panel 40. Game play area 22 includes an apron 132 and a target on upper subpanel 28 of rear panel 25, such as a backboard 134. Apron 132 extends from rear panel 25 to front panel 40, over intermediate body panel 50 and intermediate body panel 60. Backboard 134 may extend along the upper subpanel 28 of rear panel 25 and optionally may be attached to apron 132. An upper portion of front panel 40 may extend above apron 132 to serve as a front wall or bumper.

Side nets 136, 138 are attached to rear panel 25 at a net support 90 and along upper panel 28. One side net 136 extends along one side of backboard 134 and apron 132 to front panel 40. A corresponding side net 138 is attached to rear panel 25 at the other net support 90 and to the opposite vertical strut 30. Side net 138 extends along the opposite side of backboard 134 and apron 132 as side net 136 to front panel 40. Side nets 136, 138 form side walls along game play area 22 to assist in collecting game balls and other objects used with arcade game 15.

In one embodiment, one or more basketball rims 140 are attached to backboard 134 so that frame 20 may be used as a basketball game. A player stands adjacent to front panel 40 and shoots a basketball at a basketball rim 140. After the shot, the basketball is collected by apron 132. Apron 132 is optionally arranged on an incline so that the basketball is returned to the player so that the basketball may be shot again. A score counter and a timer may be included with frame 20 to keep track of how many baskets the player has made in a given amount of time.

Typically, when in use, the one or more basketball rims 140 extend substantially perpendicularly from backboard 134 and rear panel 25. However, the one or more basketball rims 140 may be hinged so that each basketball rim 140 is arranged substantially parallel to backboard 134 and rear panel 25 when not in use, allowing more compact storage.

Figure 9:
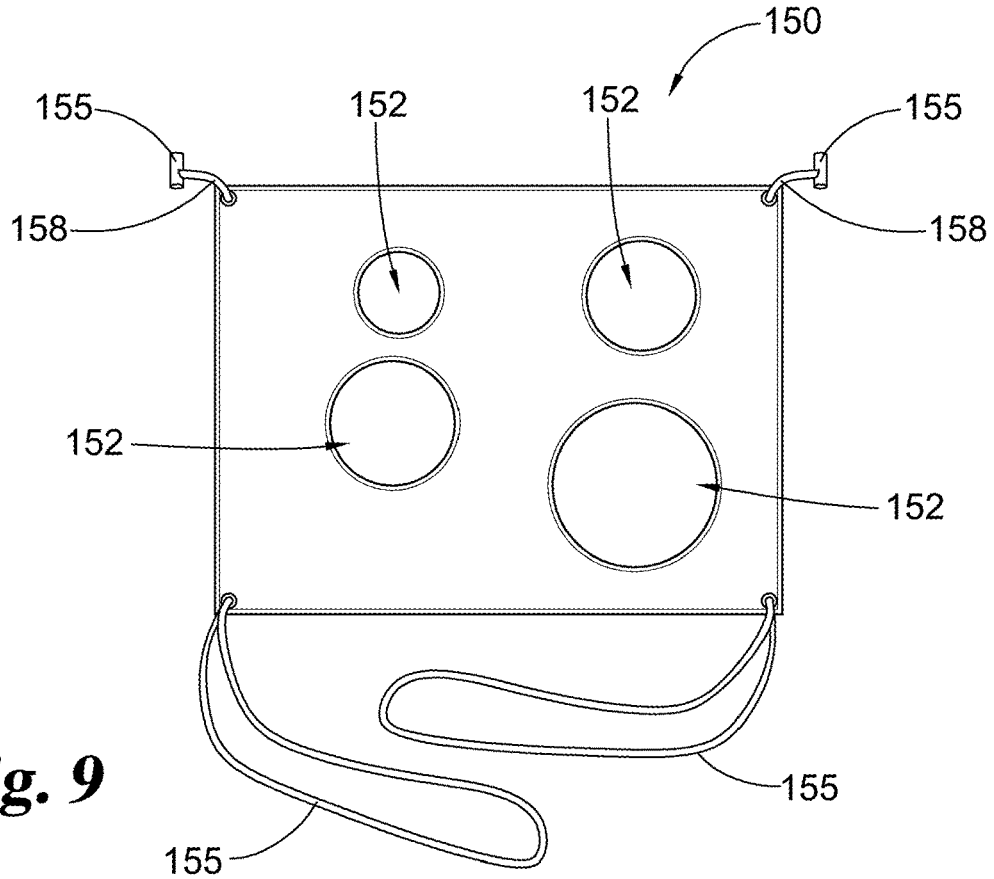
FIG. 9 is a front view of a ball toss screen for the arcade game of FIG. 1.

The target of frame 20 may also include a ball toss screen 150, shown in FIG. 9. Ball toss screen includes one or more target openings 152. A player stands near front panel 40 and throws an object such as a baseball or a football at the ball toss screen 150, trying to throw the object through a target opening 152. The target openings 152 may be of varying sizes to make it easier or harder to throw an object through the target opening 152.

Figure 10:
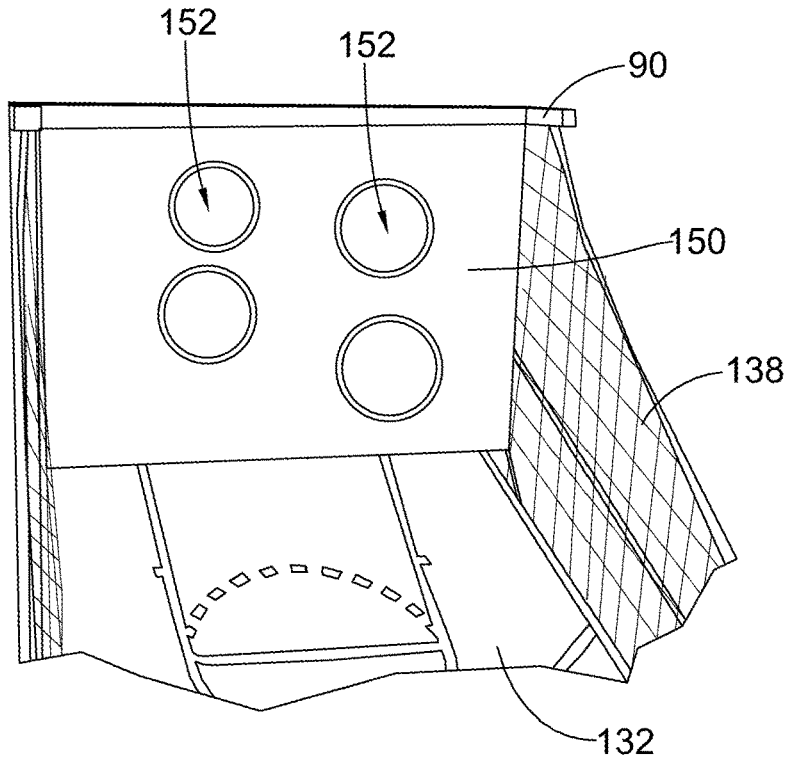
FIG. 10 is a perspective view of the ball toss screen of FIG. 9 attached to the arcade game.

Ball toss screen 150 is attached to frame 20 in front of backboard 134 and any basketball rims 140 that may be attached to backboard 134 (see FIG. 10). As shown in FIG. 9, in one embodiment, ball toss screen 150 includes attachment mechanisms 155 at each corner of ball toss screen 150. However, in other embodiments, more attachment mechanisms 155 or fewer attachment mechanisms 155 may be included, or the attachment mechanisms 155 may be attached at different positions on ball toss screen 150.

Attachment mechanism 155 may be any device or mechanism that is capable of securing ball toss screen 150 to rear panel 25, such as strings or elastic bands. In the embodiment shown, the attachment mechanisms 155 at the bottom corners of ball toss screen 150 are cords that may be tied around a vertical strut 30 or a support strut 32, 33 of rear panel 25. Attachment mechanisms 155 at the top corners of ball toss screen 150 include tabs 158 that are configured to be threaded lengthwise through corresponding eyelets arranged where the ball toss screen is to be attached. The tabs 158 are then rotated so that the length of tab 158 is transverse to the eyelet so that tab 158 does not disengage from the eyelet. The top corners of ball toss screen 150 may be attached to rear panel 25 or may be attached to net supports 90. Tabs 158 may be fit into eyelets or other openings within net supports 90 or attached to net supports 90. In other embodiments, the attachment mechanisms 155 for the top of ball toss screen 150 may be cords that are tied around net supports 90.

Figure 11:
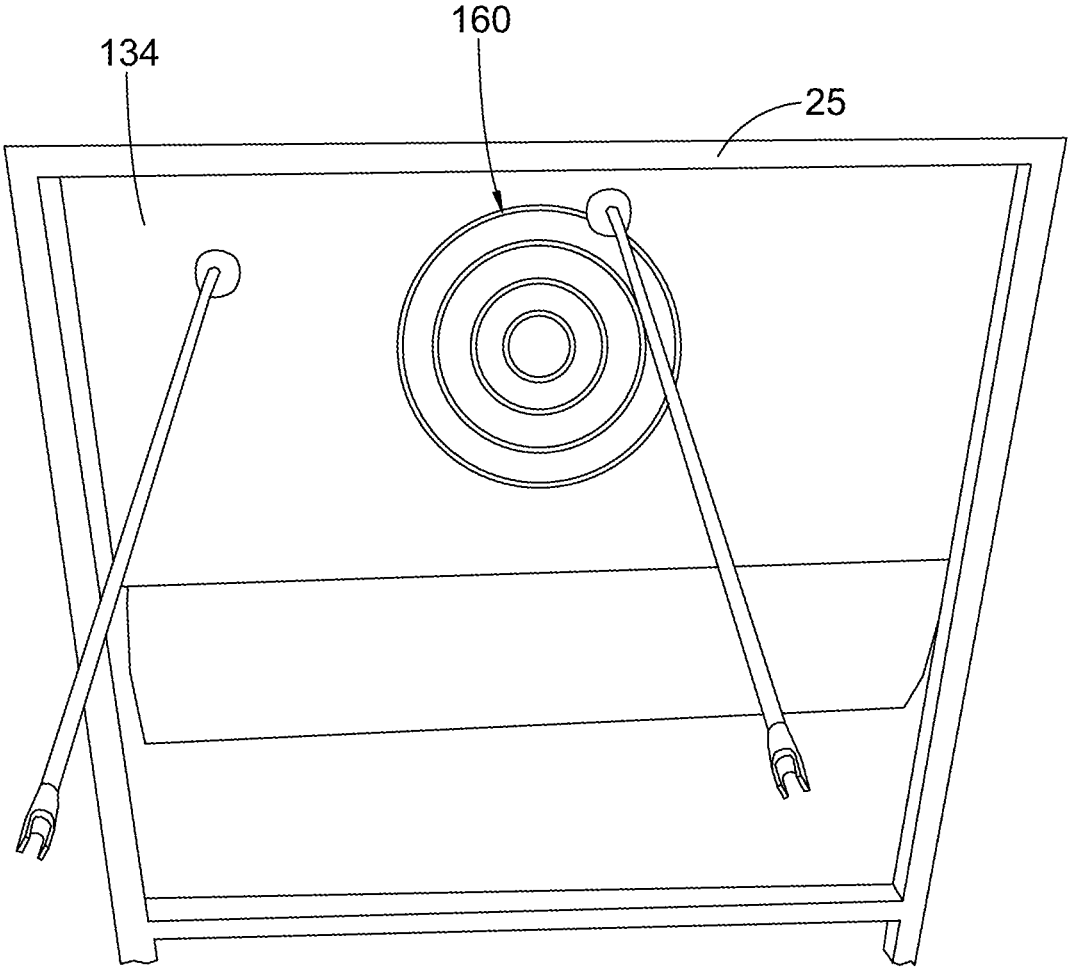
FIG. 11 is a rear view of the arcade game of FIG. 1 with a target.

Frame 20 may also include an archery target 160 for archery or darts or any other desired object, as shown in FIG. 11. Archery target 160 may be on the back of rear panel 25, on the opposite side of basketball rims 140. In other embodiments, archery target 160 may be separate from backboard 134 and attached to the upper subpanel 28 of rear panel 25. Archery target 160 may also be attachable to net supports 90 so that archery target 160 may be hung in front of basketball rims 140, similar to ball toss screen 150. A magnetic backing (not shown) or a smooth and/or rigid front surface may be included with archery target 160 so that an arrow, dart, or other object with a magnetic end, suction cup, or other type of adhesive surface may stick to archery target 160.

When in use, frame 20 is set up in an unfolded configuration as shown in FIG. 1. However, the pivot connections 100 between adjacent panels allows frame 20 to be folded into a much smaller, collapsed configuration for storage or to allow for easy portability. An example of a process for converting frame 20 from the unfolded configuration to the collapsed configuration in FIG. 2 is conceptually shown in FIGS. 12-15.

Figure 12:
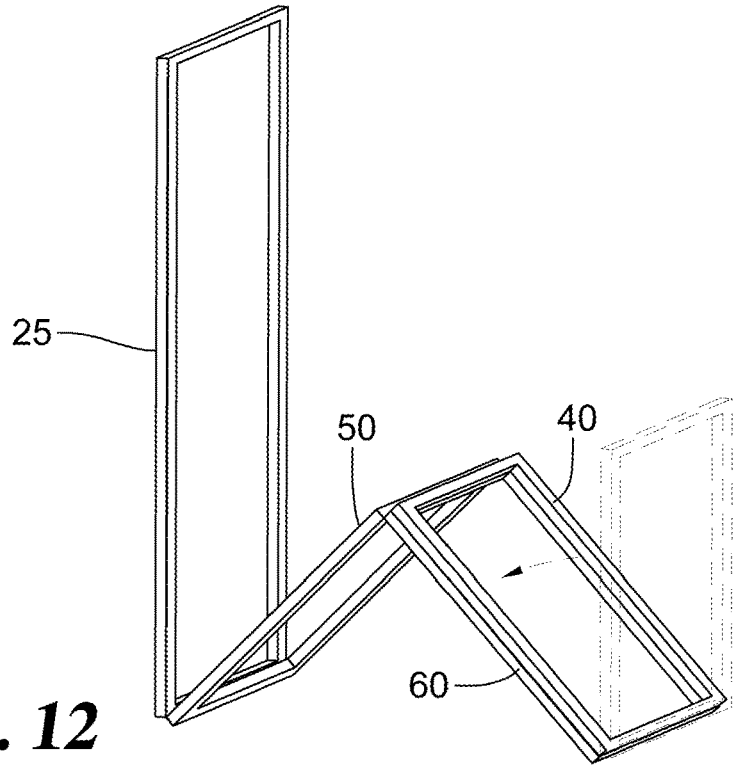
FIG. 12 is a perspective view of the frame of FIG. 2 in a partially collapsed configuration.
Figure 13:
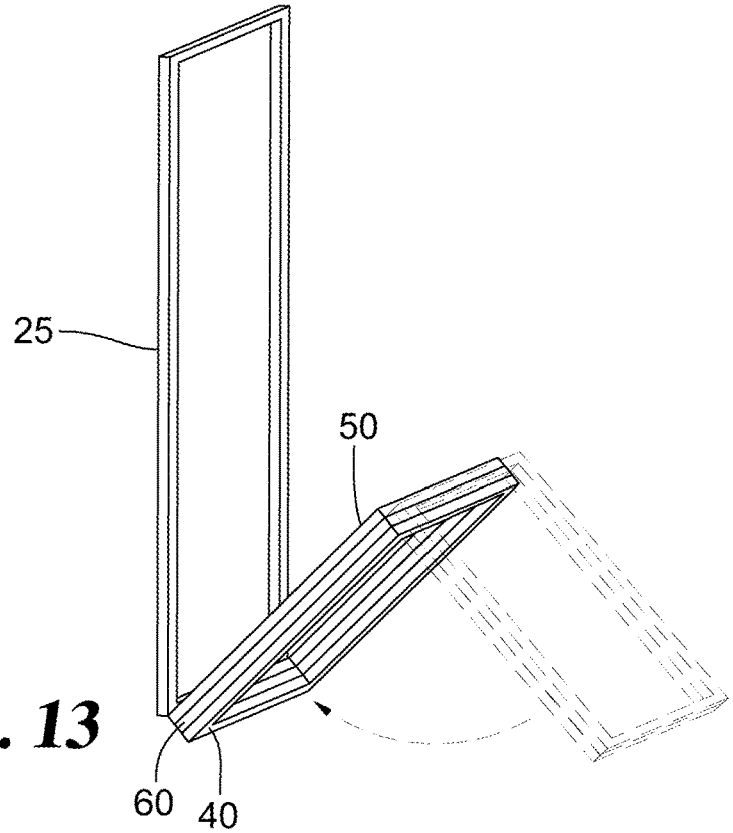
FIG. 13 is a perspective view of the frame of FIG. 2 in a partially collapsed configuration.

In FIG. 12, front panel 40 and body panel 60 are unlocked so that front panel 40 is able to be pivoted so that front panel 40 is substantially parallel to body panel 60. In some embodiments, tension in the cables 80 is reduced by pivoting front panel 40 with respect to body panel 60. As shown in FIG. 13, body panel 60 and body panel 50 are pivoted so that the combination of body panel 60 and front panel 40 are parallel to body panel 50.

Figure 14:
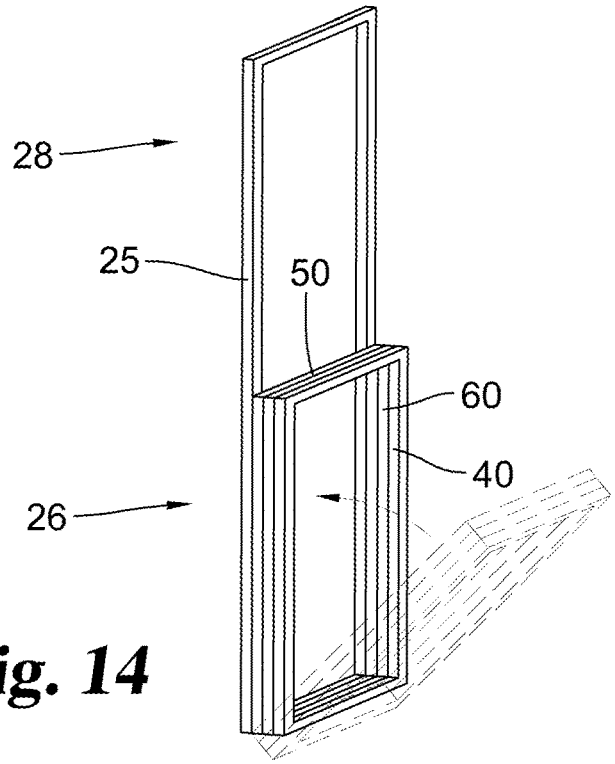
FIG. 14 is a perspective view of the frame of FIG. 2 in a partially collapsed configuration.

In FIG. 14, body panel 50 is pivoted with respect to rear panel 25. Body panel 50, along with body panel 60 and front panel 40 are parallel to the lower subpanel 26 of rear panel 25. Upper subpanel 28 of rear panel 25 is folded parallel to rear panel 25 into a fully collapsed configuration. The order of folding the panels can be varied.

Figure 15:
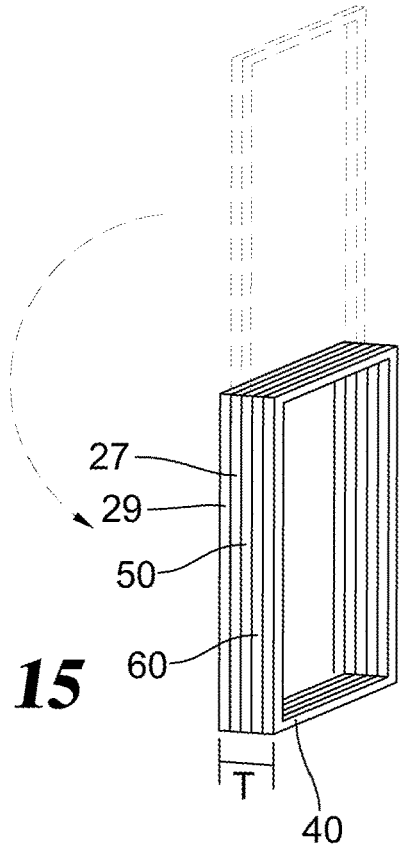
FIG. 15 is a perspective view of the frame of FIG. 2 in a collapsed configuration.

As shown in FIG. 15, in the fully collapsed configuration, rear panel 25, front panel 40, body panel 50, and body panel 60 are parallel to each other to form a stack of panels. With upper subpanel 28 of rear panel 25 folded with respect to lower subpanel 26 of rear panel 25, the height of the collapsed rear panel is no taller than the taller of the two subpanels.

The result of the folding process is a compact frame 20 that has a much smaller footprint than when frame 20 is in an unfolded configuration. In the embodiment shown, the folded frame 20 is about the length and width of the body panels 50, 60 or the front panel 40 with a total thickness T defined by the stacked thickness of the panels. In the collapsed configuration, frame 20 can be fit within a bag or a case so that frame 20 may be portable. In some embodiments, the bag or case may also hold the projectile items to be directed at the target, such as basketballs, footballs, or arrows. The smaller footprint of the collapsed configuration and the hinged connections between panels also allows for arcade game 15 to be packaged for sale and transported pre-assembled yet within a compact box or case without the need for further assembly after unpacking.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected.

The invention claimed is:

1. An arcade game system, comprising:

a frame including rectangular panels, wherein each panel is formed from an assembly of struts arranged in a planar configuration, wherein the frame includes:

a rear panel including an upper section and a lower section wherein said upper section is foldable with respect to said lower section;

a first body panel pivotally connected to said rear panel;

a second body panel pivotally connected to said first body panel;

a front panel pivotally connected to said second body panel;

wherein said frame includes an unfolded configuration including a player position adjacent to and in front of said front panel and wherein said unfolded configuration includes:

a game play area defined between said rear panel and said front panel and above said first body panel and said second body panel;

a target on said upper section of said rear panel;

an apron extending from said rear panel to said front panel beneath said game play area and over said first body panel and said second body panel;

wherein when said frame is in said unfolded configuration said first body panel is positioned at an oblique angle with respect to said rear panel and said second body panel is positioned at an oblique angle with respect to said front panel;

wherein said frame includes a collapsed configuration wherein each of said rear panel, first body panel, second body panel, and front body panel are parallel to each of the other panels to form a stack of panels;

wherein each of said first body panel, said second body panel, and said front body panel maintain the same size and rectangular shape while pivoting between the collapsed configuration and the unfolded configuration; and wherein in the unfolded configuration the rear panel has a height that is greater than a height of the front panel and in the collapsed configuration the height of the rear panel is shorter than the height of the rear panel in the unfolded configuration.

2. The arcade game system of claim 1, wherein in the unfolded configuration, the panels of said frame form a W-shaped profile when viewed from a side perspective.

3. The arcade game system of claim 1, further comprising:

one or more hinged braces, wherein each hinged brace includes a first support arm and a second support arm connected by a hinge;

wherein said first support arm is connected to one of said panels and wherein the second support arm is connected to one of said panels that is pivotally connected to the panel to which the first support arm is connected;

wherein each hinged brace includes a locked position in which said first and second support arms are positioned linearly, and wherein when said support arms are in the locked position the panels attached to said hinged brace are restricted from pivoting; and wherein each hinged brace includes an unlocked position in which said support arms are positioned non-linearly with respect to each other, and wherein when said support arms are in the unlocked position, the panels attached to said hinged brace are permitted to pivot.

4. The arcade game system of claim 1, further comprising:

a cable including two ends, wherein a first end of said cable is attached to said upper section of said rear panel and a second end of said cable is attached to said front panel; and wherein when said frame is in the unfolded configuration the cable is in tension and prevents said upper section of said rear panel from folding with respect to said lower section.

5. The arcade game system of claim 1, further comprising:

a first net support pivotally attached to the upper section of said rear panel;

a second net support pivotally attached to the upper section of said rear panel; and wherein a first net is attachable to said first net support and a second net is attachable to said second net support.

6. The arcade game system of claim 1, wherein said upper section of said rear panel folds rearwardly with respect to said lower section of said rear panel.

7. The arcade game system of claim 1, wherein said second body panel is pivotally connected to a lower section of said front panel.

8. The arcade game system of claim 1, wherein said first body panel is pivotally connected to said rear panel on a single axis defined by a first pair of hinges;

wherein said second body panel is pivotally connected to said first body panel on a single axis defined by a second pair of hinges; and wherein said front panel is pivotally connected to said second body panel on a single axis defined by a third pair of hinges.

9. An arcade game system, comprising:

a frame including rectangular panels, wherein each panel is formed from an assembly of struts arranged in a planar configuration, and wherein the frame includes:

a rear panel including an upper section and a lower section;

a first body panel pivotally connected to said rear panel;

a second body panel pivotally connected to said first body panel;

a front panel pivotally connected to said second body panel;

wherein said frame includes an unfolded configuration including a player position adjacent to and in front of said front panel and wherein said unfolded configuration includes:

a game play area defined between said rear panel and said front panel and above said first body panel and said second body panel;

a target on said upper section of said rear panel; and wherein when said frame is in said unfolded configuration said first body panel is positioned at an oblique angle with respect to said rear panel and said second body panel is positioned at an oblique angle with respect to said front panel;

wherein said frame includes a collapsed configuration wherein each of said rear panel, first body panel, second body panel, and front body panel are parallel to each of the other panels to form a stack of panels;

wherein each of said first body panel, said second body panel, and said front body panel maintain the same size and rectangular shape while pivoting between the collapsed configuration and the unfolded configuration; and wherein said upper section of the rear panel is foldable with respect to said lower section so that said upper section is parallel to said lower section and said upper section is included in said stack of panels.

10. The arcade game system of claim 9, wherein said upper section of said rear panel folds rearwardly with respect to said lower section of said rear panel.

11. The arcade game system of claim 9, wherein a height of said upper section of said rear panel is equal to or less than a height of the lower section of said rear panel.

12. The arcade game system of claim 9, further comprising:

a cable including two ends, wherein a first end of said cable is attached to said upper section of said rear panel and a second end of said cable is attached to said front panel; and wherein when said frame is in the unfolded configuration the cable is in tension and prevents said upper section of said rear panel from folding with respect to said lower section.

13. The arcade game system of claim 9, further comprising:

a first net support pivotally attached to the upper section of said rear panel;

a second net support pivotally attached to the upper section of said rear panel; and wherein a first net is attachable to said first net support and a second net is attachable to said second net support.

14. The arcade game system of claim 9, wherein said frame includes an unfolded configuration and wherein the panels of said frame form a W-shaped profile when viewed from a side perspective when said frame is in said unfolded configuration.

15. The arcade game system of claim 9, further comprising:

one or more hinged braces, wherein each hinged brace includes a first support arm and a second support arm connected by a hinge;

wherein said first support arm is connected to one of said panels and wherein the second support arm is connected to one of said panels that is pivotally connected to the panel to which the first support arm is connected;

wherein said one or more hinged braces include a locked position in which said first and second support arms are positioned linearly, and wherein when said support arms are in the locked position the panels attached to said hinged brace are restricted from pivoting; and wherein said one or more hinged braces include an unlocked position in which said support arms are positioned non-linearly with respect to each other, and wherein when said support arms are in the unlocked position, the panels attached to said hinged brace are permitted to pivot.

16. A method for arranging an arcade game with a frame including a front panel, a rear panel, and first and second body panels into a collapsed configuration, comprising:

providing the frame in an unfolded configuration wherein said first body panel is positioned at an oblique angle with respect to said rear panel and said second body panel is positioned at an oblique angle with respect to said front panel;

pivoting said front panel with respect to said second body panel on a single axis defined by a first pair of hinges so that said front panel is parallel to said second body panel;

pivoting said second body panel with respect to said first body panel on a single axis defined by a second pair of hinges so that said second body panel and said front panel are parallel to said first body panel;

pivoting said first body panel with respect to said rear panel on a single axis defined by a third pair of hinges so that said first body panel, said second body panel, and said front panel are parallel to said rear panel; and folding an upper section of said rear panel rearwardly with respect to a lower section of said rear panel so that the upper section of said rear panel is parallel to the lower section of said rear panel;

wherein each of said first body panel, said second body panel, and said front body panel maintain the same size and shape while pivoting between the collapsed configuration and the unfolded configuration.

17. The method of claim 16, wherein in the collapsed configuration a height of the frame is not greater than a height of the lower section of the rear panel.

18. The method of claim 16, wherein the upper section of said rear panel is folded so that said upper section of said rear panel is directly adjacent to said lower section of said rear panel.

19. The method of claim 16, wherein said front panel is positioned at an oblique angle with respect to said second body panel prior to pivoting said front panel with respect to said second body panel.

20. The method of claim 19, wherein said second body panel is positioned at an oblique angle with respect to said first body panel prior to pivoting said second body panel with respect to said first body panel.

* * * * *